United States Patent [19]

Brown et al.

[11] 4,392,739

[45] Jul. 12, 1983

[54] ELECTROMECHANICALLY OPERATED FUSER ROLL CLOSURE

[75] Inventors: Leon C. Brown, Boulder County, Colo.; Jesse L. Campbell, Pima County, Ariz.; Uscoe J. Fitts, Fujisawa, Japan; Willard L. Gudgel, Boulder County, Colo.

[73] Assignee: International Business Machines Corporation, Armonk, N.Y.

[21] Appl. No.: 356,682

[22] Filed: Mar. 10, 1982

Related U.S. Application Data

[63] Continuation-in-part of Ser. No. 145,084, Apr. 30, 1980, Pat. No. 4,363,549.

[51] Int. Cl.[3] ..... G03G 15/20

[52] U.S. Cl. ..... 355/3 FU; 219/216; 355/14 FU; 432/60

[58] Field of Search ..... 355/3 R, 3 SH, 3 FU, 355/14 FU; 219/216; 432/60, 228

[56] References Cited

U.S. PATENT DOCUMENTS

| | | | |
|---|---|---|---|
| 2,342,203 | 2/1944 | Kohler | 118/235 |
| 4,038,026 | 7/1977 | Wada et al. | 432/60 |
| 4,050,803 | 9/1977 | McCarroll | 355/3 R |
| 4,121,089 | 10/1978 | Bishop | 432/60 X |
| 4,142,793 | 3/1979 | Schilling | 355/58 |
| 4,272,666 | 6/1981 | Collin | 355/3 FU X |

OTHER PUBLICATIONS

Gaitten et al., "Pressure Roll Support"; IBM Technical Disclosure Bulletin; vol. 15, No. 12, May 1973, p. 3644.

*Primary Examiner*—Fred L. Braun

*Attorney, Agent, or Firm*—G. A. Conley; E. C. Hancock; J. Jancin, Jr.

[57] ABSTRACT

A fuser roll apparatus in a toner fixing station associated with an electrophotographic or xerographic device for fixing a toner image onto a copy sheet by the application of heat and pressure. The fusing apparatus includes a pair of fuser rollers and a linkage mechanism coupling a control cam and the fuser rollers. An electromechanically operated latch, in the form of a solenoid, is interposed in the linkage mechanism coupling the control cam and fuser rollers. So long as the solenoid is energized, the opening of the rollers is controlled solely by the rotation of the cam. If the solenoid is deenergized however, the rollers are maintained in an open position. Thereafter, until the solenoid is again energized, the rollers remain open and are unaffected by rotational movement of the cam.

14 Claims, 8 Drawing Figures

FIG. 5
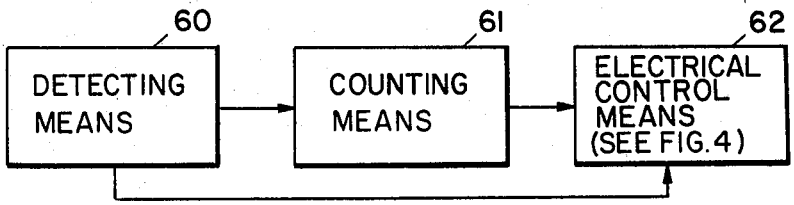
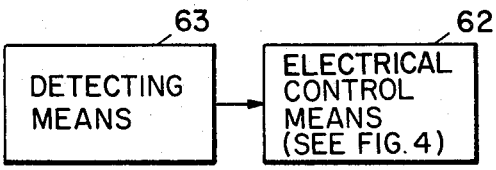
FIG. 6
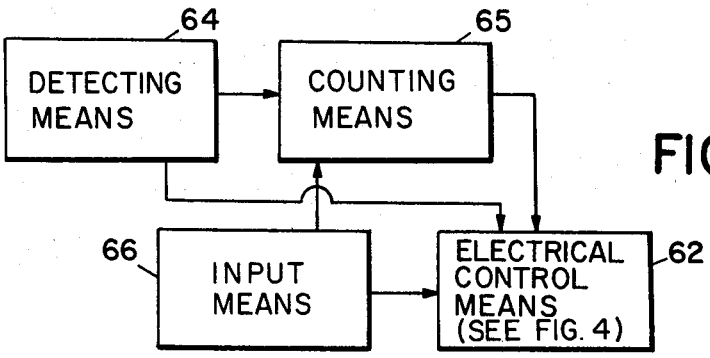
FIG. 7
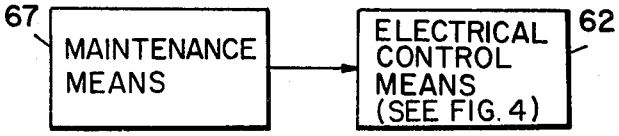
FIG. 8

ELECTROMECHANICALLY OPERATED FUSER ROLL CLOSURE

DESCRIPTION

This is a Continuation-in-Part of Application Ser. No. 145,084 filed Apr. 30, 1980, now U.S. Pat. No. 4,363,549.

TECHNICAL FIELD

This invention relates generally to a fuser roll apparatus in a toner fixing station associated with an electrophotographic or xerographic device and more particularly to such an apparatus wherein an electromechanically operated latch is provided for selectively moving the heated fuser roll and associated backup roll into and out of circumferential engagement.

BACKGROUND ART

In the process of xerography, a light image corresponding to the original to be copied is typically recorded in the form of a latent electrostatic image upon a photoconductive member. This latent image is developed, that is to say, made visible, by the application of a pigmented thermoplastic resin, commonly referred to as toner. The thus developed latent image is thereafter transferred from the photoconductive member onto a copy medium, such as for example, a copy sheet or portion of a roll of paper. The copy medium is subsequently passed through a fusing apparatus which affixes the image onto the medium and is later discharged from the machine as a final copy.

One approach to fixing the toner particles onto the copy sheet has been to pass the copy sheet with toner images thereon through a fusing nip formed by a heated fuser roll and a backup roll. As it passes therethrough, the copy sheet is simultaneously pressed and heated so that the toner becomes softened and firmly attached to the copy sheet.

In such a fusing arrangement, opening and closing of the fuser nip is commonly controlled by a cam rotatable in synchronization with movement of the copy sheets. Frequently therefore, during the processing of variable length sheets (i.e., sheets of different length than the selected standard which is the longest anticipated sheet length), the rollers are allowed to remain in contact during periods in which no copy sheet is disposed therebetween. This prolonged direct contact commonly results in the overheating of the backup roll. Such overheating of the roller may result in a paper jam as the copy sheet will tend to follow the backup roll rather than continuing along the intended paper path beyond the fuser station. This backup roll sticking problem is especially aggravated during the fusing of duplex copies (i.e., sheets with toner copy on both sides) due to the cohesive nature of the toner. Overheating of the roller surface may also result in a phenomena referred to in the printing art as "offset" wherein toner adheres to the roller surface and is transferred to the next copy sheet.

Substantial damage may also be caused to the rollers from entrapment of copy sheets between the heated fuser roll and the backup roll when there is a loss of power during a copying operation. It is desirable therefore that the fuser rollers remain in an open position during standby mode and similarly during a copying operation that the fusing nip be closed only when there is paper between the rollers. Thus, it is desirable that the fusing nip be opened during the intersheet gap that may exist between adjacent copy sheets and be closed only when the next sheet arrives. Likewise, when a paper jam is detected, control of the closure mechanism is desirable so that fuser roller opening may be effected and damage to the rollers avoided. Further, it is desirable to open the fuser nip to facilitate maintenance. IMB TDB "Fuser Configuration" (5/81, pp. 5622–5623) describes the details of a pivoting and latching mechanism useful for this purpose.

Prior devices frequently control the operation of a cam and thereby the opening and closing of the fuser rollers. For example, U.S. Pat. No. 4,038,026 utilizes a spring clutch to actuate a roll closure cam in response to copy sheet position sensing. Such devices, while providing for the interruption of fuser roller closure upon the occurrence of certain conditions, are dependent on the coasting effect of the apparatus. It is necessary therefore, that the clutch act as a single-turn clutch, so that when interrupted, the cam does not stop immediately but rather continues to travel through an angle sufficient to effect the opening of the rollers. Such an arrangement is especially disadvantageous in the case of a loss of power during a copying operation as the machine often will not coast far enough to operate the cam to effect opening of the rollers. IBM TDB "Electromagnetically Latchable Damper Assembly" (7/80, pp. 474–475) describes an interruptable linkage arrangement which allows for the fuser rollers to be opened via deenergizing an electromagnet. This arrangement allows for fuser roller opening upon a power loss, but deenergization of the solenoid is not otherwise associated with the occurrence of other conditions upon which opening the fuser rollers is desired.

Accordingly, it is a principal object of this invention to provide an improved xerographic toner fixing apparatus.

It is another object of this invention to provide a toner fixing apparatus which allows the operation of heated fuser roll and backup roll opening and closing under mechanical cam control for standard operations, but which permits overriding or interrupting the cam closure mechanism upon the occurrence of certain conditions.

Another object of this invention is to provide a toner fixing apparatus which provides for the operation of heated fuser roll and backup roll opening and closing independent of machine coast.

A further object of this invention is to provide a toner fixing apparatus capable of fusing toner images onto a copy sheet without toner offset.

Still another object of this invention is to provide a toner fixing apparatus which avoids fuser roller damage caused by copy sheet entrapment.

DISCLOSURE OF THE INVENTION

The embodiment disclosed for the present invention provides an improved fuser roller closure mechanism in an electrophotographic or xerographic device having a pair of fuser rollers and a linkage mechanism coupling a control cam and the fuser rollers. In accordance with the invention, an electromechanically operated latch or selectively engageable latch, in the form of a solenoid, is interposed in the linkage mechanism coupling the control cam and fuser rollers. The solenoid is arranged so that a portion of its magnetic flux path passes through each of two independently pivotable arms. One of the arms acts as a cam follower and the other is coupled to the fuser rollers. The latter arm effects opening and closing of the fuser nip. So long as the solenoid is operated (i.e., energized via application of actuation power to the solenoid), the mechanism is controlled solely by the rotation of the cam. If the solenoid is not operated (i.e., deenergized via deactuation) however, the arms become disengaged (i.e., separated) and the fuser rollers are maintained in an open position. Thereafter, until the solenoid is again operated, the rollers are unaffected by rotational movement of the cam.

In a fuser having a heated fuser roller and a backup roll, the present invention makes it possible to maintain the backup roll cool and separated from the heated roll. It is thereby possible to operate the fuser so that the rolls are only closed when a copy sheet is between them. This keeps the backup roll cooler to eliminate toner melting on the backup roll which can cause a jam from paper becoming attached to the backup roll. Another advantage of separating the rolls except when copy paper is between them is that toner transfer from the heated roll to the backup roll is minimized. Of course, early roll closure to stabilize the operating parameters (e.g., temperature) prior to copy sheet fusing is possible, if desired.

BRIEF DESCRIPTION OF THE DRAWING

The invention will now be particularly described by way of example, with reference to the accompanying drawing in which:

FIG. 5 is a block diagram representation of another apparatus for controlling the solenoid.

FIG. 6 is a block diagram representation of still another apparatus for controlling the solenoid.

FIG. 7 is a block diagram representation of still another apparatus for controlling the solenoid.

FIG. 8 is a block diagram representation of still another apparatus for controlling the solenoid.

BEST MODE FOR CARRYING OUT THE INVENTION

Figure 1:
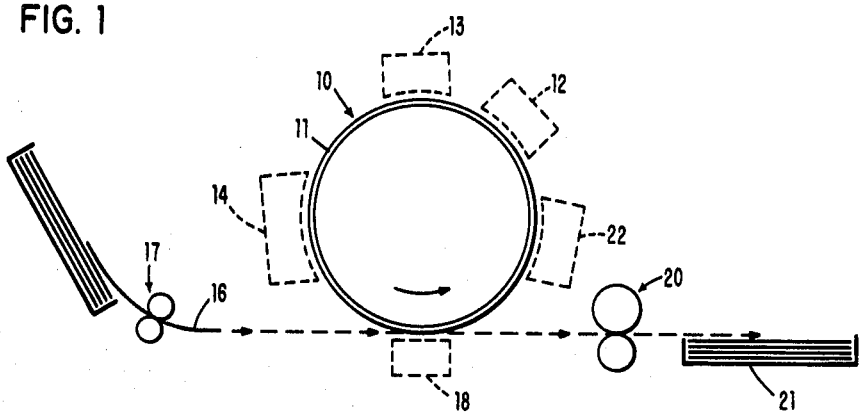
FIG. 1 is a schematic representation of a xerographic copying apparatus having a fuser roller fixing station incorporating the features of the present invention therein.

Referring to FIG. 1, there is depicted schematically, the various components of a typical xerographic copying apparatus in which the features of the present invention may be implemented.

Inasmuch as the art of xerographic copying is well known, the various processing stations for producing a copy of an original document are represented in FIG. 1 in block form, and are defined in terms of functionality.

Still referring to FIG. 1, the xerographic copying apparatus includes a rotatable drum 10 have a photoconductive surface 11. As the drum rotates in a counterclockwise direction, photoconductive surface 11 is caused to pass sequentially through a series of xerographic processing stations.

The first of these stations is a charging station 12 where a uniform electrostatic charge is deposited onto the photoconductive surface.

The second, exposure station 13, includes an exposure mechanism having a stationary housing for supporting the original (i.e., master) document to be copied. At station 13, the original document is scanned by means not shown in a timed relationship with the movement of drum 10 to form a light image thereof. This light image is projected onto the charged portion of photoconductive surface 11. In this manner, the charge in the exposed areas of surface 11 is dissipated, thereby forming a latent electrostatic image on surface 11 which corresponds to the informational areas of the original document.

The latent electrostatic image recorded on photoconductive surface 11 is then rotated to development station 14. At station 14, xerographic developing material, including toner particles having an electrostatic charge opposite that of the latent electrostatic image, is introduced to the latent electrostatic image to form a toner powder image on the photoconductive surface.

With continued reference to FIG. 1, a copy sheet 16 is advanced by sheet feeding apparatus 17 to transfer station 18. Sheet 16 is advanced into contact with drum 10 in a timed sequence so that the toner powder image developed on photoconductive surface 11 contacts the advancing copy sheet at transfer station 18. Once the toner powder image is transferred to sheet 16, the sheet is advanced to toner fusing assembly 20, where the toner powder image is permanently affixed to the copy sheet. The detailed operation of the toner fusing assembly will be described hereinafter in greater detail with reference to FIG. 2.

Once the fusing operation is completed, the finished copy sheet passes to an output tray 21. The surface of drum 10 is thereafter cleaned at drum cleaning and discharge station 22 in preparation for the next copy cycle.

Figure 2:
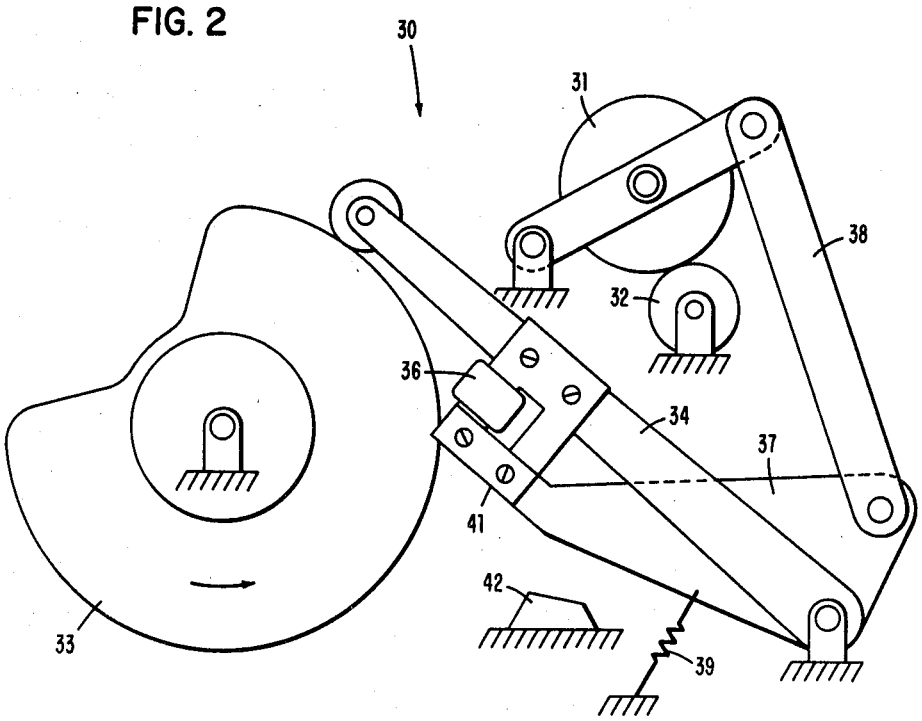
FIG. 2 is a schematic representation of the electromechanically operated latch assembly for selectively moving a heated fuser roll and associated backup roll into and out of circumferential engagement.

Referring now to FIG. 2, fuser assembly 30 includes a heated fuser roll 31 and a backup roll 32. Heated fuser roll 31 cooperates with backup roll 32 to define a fusing nip through which a sheet of copy material having a toner image thereon passes. The copy sheet is so oriented that the side thereof bearing the toner image contacts heated fuser roll 31. The toner image is thereby affixed to the copy sheet. The fusing nip formed by fuser rollers 31 and 32 is designed so as to be capable of being opened and closed under mechanical cam control, the cam 33 being rotatable in synchronization with the movement of the copy sheets relative to the rollers. Pivoted on cam 33 and mounted thereon so as to follow the contour of the cam is follower arm 34 to which solenoid 36 is attached. Also pivoted on the same shaft is lever arm 37 which through linkage 38 is connected so as to be capable of effecting the shifting of the surfaces of backup roll 32 and heated fuser roll 31 between open (i.e., no surface contact) and closed (i.e., surface contact) positions. Spring means 39 are provided for normally biasing user rollers 31 and 32 in an open position. Other suitable biasing means may be used to accomplish the same result.

The closed loop magnetic flux path of solenoid 36 includes a portion of follower arm 34 and of lever arm 37. Actuation of solenoid 36 while the magnetic flux path portions of the arms are in proximity to each other, causes lever arm 37 to which armature 41 is attached and follower arm 34 to become fixedly connected. Once connected, the arms move as a unit and further cause backup roll 32 and heated fuser roll 31 to open and close in response to the rotation of cam 33. The contour of cam 33 is designed to facilitate opening and closing of the fuser rollers based on the trailing and leading edges, respectively, of a sheet with a predetermined maximum anticipated length. This ensures that all sheets of equal or shorter length than a predetermined maximum anticipated length will be properly fused (i.e., the fuser rollers can remain in contact for at least the entire length of the sheet). IBM TDBs "Electromagnetically Latchable Damper Assembly" (7/80, pp. 474–475) and "Dual-Function Solenoid Core" (11/79, p. 225) describe details of solenoid construction potentially useful as components for lever or linkage control.

Figure 3:
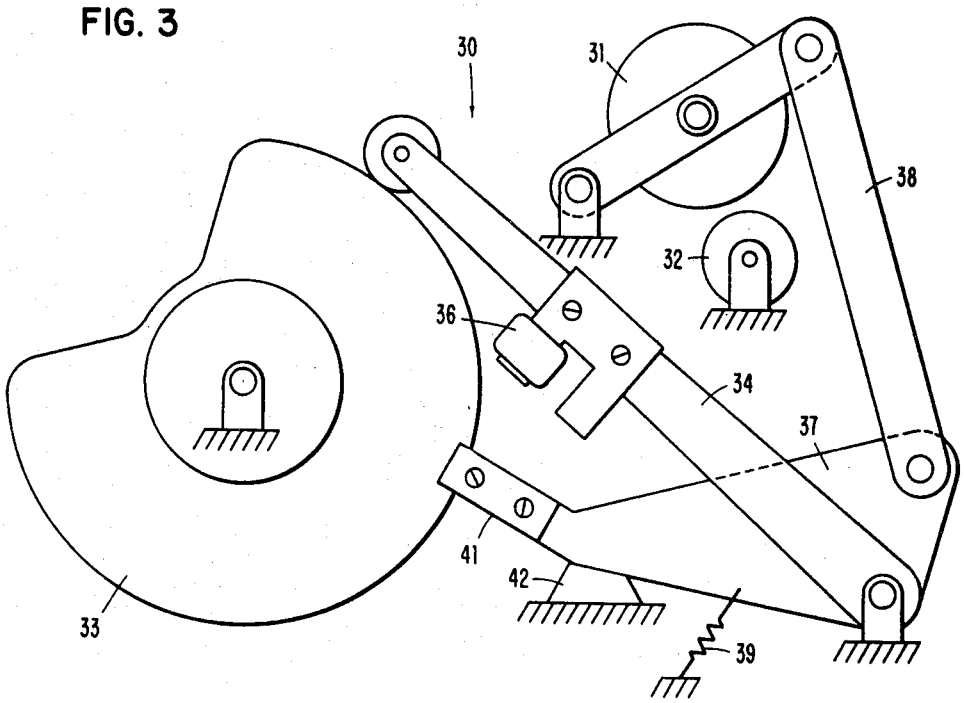
FIG. 3 is a schematic representation of the electromechanically operated latch assembly when the solenoid of the latch assembly is deenergized and the fuser rollers are thereby always in an open position.

Some xerographic copying devices apply a release agent, such as a silicone oil to the outer surface of the heated fuser roll so as to provide the heated fuser roll with an outer surface which has a relatively low affinity to tackified toner particles. While the use of the silicone oil release agent has minimized some of the problems associated with the use of the fuser assembly, occasionally, toner particles may be nonetheless offset to the heated fuser roll. As a result, toner particles are transferred to the surface of the heated fuser roll with subsequent transfer to the backup roll during periods when no copy paper is in the nip. Toner particles may also be picked up by the backup roll during fusing of duplex copies. As a result of this toner offset, the copy sheet often becomes wrapped about the backup roll or heated fuser roll, thereby causing jamming due to the cohesive nature of the toner. The fuser apparatus in accordance with the present invention is so designed that when a paper jam is detected or when maintenance is required, solenoid 36 is deenergized thereby allowing follower arm 34 and lever arm 37 to separate under the force applied by biasing spring 39 as shown in FIG. 3. Lever arm 37 then moves to stop 42. Deenergization of solenoid 36 thus results in the immediate separation of fuser rollers 31 and 32 by effectively interrupting the cam linkage. Thereafter, until solenoid 36 is again energized, heated fuser roll 31 and backup roll 32 remain in an open position and are unaffected by the rotational movement of the cam. That is, deenergizing solenoid 36 provides the capability to override the opening and closing of the fuser rollers dictated by the contour of cam 33.

The interposition of the solenoid in the control linkage in this manner, allows for the selective interruption of the closure mechanism. Thus, during the copying of variable length sheets, opening of the fusing nip during the intersheet gap may be easily effected by deenergization of the solenoid. Put another way, the cam itself is conventional and is designed for paper of a predetermined maximum anticipated length. The cam is mechanically interconnected to control opening and closing of the fuser rollers in an appropriately timed relation as such maximum length sheets are fused. Whenever a shorter sheet is being handled, the solenoid is deenergized at a point in time correlated to the actual sheet length being handled. This results in an appropriately earlier fuser roller opening than for the longer sheets. Such opening results in a reduction in the occurrence of overheating of the backup roll and therefore the adverse consequences associated therewith, for example, backup roll sticking. Similarly, the fuser rollers will assume an open position whenever there is a loss of power, as in such a case, the solenoid will be automatically deenergized. The problems of copy sheet entrapment and roller damage, associated therewith, are thereby avoided.

Figure 4:
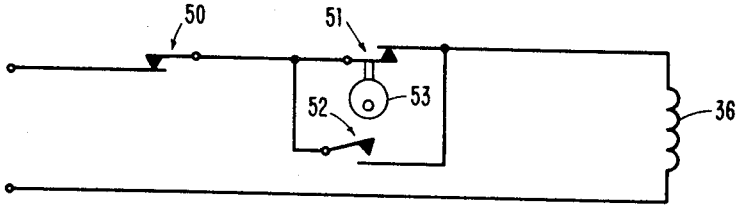
FIG. 4 is a schematic representation of electrical circuitry for controlling the energization of the solenoid of the latch assembly.

The basic circuitry for controlling the energization and deenergization of solenoid 36 to open and close the fuser rollers can include an arrangement of switches such as that shown in FIG. 4. Normally closed switch 50 is employed in the circuit, for example, to deenergize solenoid 36 in response to the detection of sheets shorter than a predetermined maximum anticipated sheet length and the detection of a paper jam or some other condition requiring maintenance for which fuser roller opening is desired. On the detection of these conditions, switch 50 is opened and the solenoid deenergized. Switch 51 is provided so as to be opened and closed cyclically as cam 53 is rotated during machine operation. If this cyclic opening and closing is timed with the rotational movement of cam 33 (see also FIG. 2), solenoid 36 can be deenergized (i.e., switch 51 can be opened) as a function of the position of cam 33. Switch 52 is normally open but is closed briefly to initiate a roll closure cycle since switch 51 is normally open until follower arm 34 at least approaches the larger radius periphery of cam 33.

In addition, switch 50 (depicted functionally as electrical control means 62 in FIGS. 5–8) may be opened in response to a preselected control input 66 such as a preselected sheet length input as illustrated in FIG. 7. This input could be, for example, the manual input by an operator which signifies that only $8\frac{1}{2}'' \times 11''$ copies will be made. Based on this selection, the cam would be automatically overridden at a point in time corresponding to $8\frac{1}{2}'' \times 11''$ copies regardless of what length of paper was actually detected (i.e., preselected control input would result in forcing the opening of the fuser rollers at a specific point in time independent of the contour of the cam or the size of paper actually detected until this selection was deactivated).

There are many ways known in the prior art to detect the size of paper on which the image is to be fused. Two examples are by way of a photodetector or switch system (e.g., a light is interrupted by the presence of paper) or by way of a timing scheme which uses the times required for paper of different sizes to be fused, (i.e., to travel a fixed distance at a fixed rate).

In the timing scheme illustrated in FIG. 5, for example, detectors 60 such as photodetectors or switches could detect the size and time of entry of a sheet into the fuser nip. A counter 61 could store the times required for various length sheets to pass through the fuser nip. Once the sheet length is detected and coupled to the counter by the detectors, the time associated with the sheet length is selected to be counted down. When entry of that sheet into the fuser nip is detected, the detectors enable the counter. After the count down is completed, the counter signals the switch (i.e. electrical controls means 62) which controls the operation of the solenoid to deenergize the solenoid. Upon entry of the next sheet the detectors would signal the switch to energize the solenoid. No count down operation is performed for sheets of a predetermined maximum length as there is no need to override the cam (i.e., the detectors do not enable the counter for sheets of a predetermined maximum sheet length). The detectors rather than the counter could also store the times. The detectors would then merely load the counter with the selected time.

A detection system 63, as illustrated in FIG. 6 can also be used without the aid of a counter or timing means by detecting the entry and exit of sheets from the fuser nip and signaling the switch which controls the solenoid to energize the solenoid upon the entry of sheets and to deenergize the solenoid upon the exit of sheets. A fuser roll closure apparatus with this type of a detection system could be implemented without a cam as the entry and exit of all sheets are treated alike (e.g., a switch could directly control the opening and closing of the fuser rollers).

A timing technique is also useful in implementing the preselected control input operation described above. A counter 65 could again store the specific fusing times associated with, various length sheets. After the count is enabled and this time has elapsed, switch 50 would be opened for the time associated with the intersheet gap (e.g, another counter within counting means 65 could be loaded with a value equal to the fusing time of an $8\frac{1}{2}''\times 11''$ copy plus the intersheet gap time between two $8\frac{1}{2}''\times 11''$ copies or the detectors 64 could detect the entry of the next sheet and close switch 50 to allow fusing). The counters would continue to reset and countdown again after reaching the selected count.

Referring to FIG. 8, as previously discussed, the fuser rollers can also be opened when, for example, a paper jam is detected. Maintenance means 67 detects the presence of a condition which requires maintenance. Upon this detection, electrical control means 62 opens the fuser rollers.

It is also important to understand that the contour of the cam can also be designed for a predetermined maximum image length. The overriding of this contour would then occur via deenergizing the solenoid when an image of less than this predetermined maximum image length is detected. This image length based configuration, as opposed to the sheet length based configuration discussed above, is useful if, for example, the paper is fed from a roll of paper instead of sheet bins with different size sheets and then cut after the image is fused to the paper. An image length based configuration would therefore allow the fuser rollers to be opened during the gap between images even though there would be paper between the fuser rollers.

While we have illustrated and described the preferred embodiments of our invention, it is to be understood that we do not limit ourselves to the precise constructions herein disclosed and the right is reserved to all changes and modifications coming within the scope of the invention as defined in the appended claims.

We claim:

1. A xerographic toner fixing apparatus comprising:

substantially parallel first and second cylindrical fuser rollers;

biasing means for maintaining the peripheral surfaces of said fuser rollers in an open position;

a rotatable cam;

means for rotating said cam;

means for serially feeding sheets between the peripheral surfaces of said fuser rollers in synchronization with the rotation of said cam, said cam having a contour for maintaining said fuser rollers in a closed position for sheets of a predetermined sheet length; a linkage mechanism coupling said cam to at least one of said fuser rollers, said linkage mechanism including:

an electromechanically operated latch, an electrical control means for selectively energizing said electromechanically operated latch, and means for shifting the peripheral surfaces of said fuser rollers between open and closed positions when said electromechanically operated latch is energized and for retaining said fuser rollers in an open position when said electromechanically operated latch is deenergized.

2. An apparatus according to claim 1 including:

detecting means coupled to said electrical control means for detecting when sheets enter and exit the fuser nip created by the closed position of said fuser rollers whereby said control means operates said latch upon entry of sheets into the fuser nip and does not operate said latch upon the exit of sheets from the fuser nip.

3. An apparatus according to claim 1 additionally comprising:

counting means coupled to said electrical control means for storing and counting the times required for sheets whose lengths are less than a predetermined maximum sheet length to pass through the fuser nip created by the closed position of said fuser rollers;

detecting means coupled to said counting means and said electrical control means for detecting the length and time of entry of sheets entering said fuser nip and for selecting the times stored in said counting means corresponding to the lengths of sheets entering said nip and also for enabling said counting means when sheets whose lengths are less than a predetermined maximum sheet length enter said fuser nip;

whereby said electrical control means operates said latch upon entry of sheets into said fuser nip and does not operate said latch upon countdown of the time required for sheets whose lengths are less than a predetermined maximum sheet length to pass through said fuser nip, thus opening said fuser rollers independent of the contour of said cam.

4. An apparatus according to claim 1 additionally comprising:

input means coupled to said electrical control means for receiving a preselected sheet length input;

counting means coupled to said electrical control means and said input means for storing and counting the times required for sheets whose lengths are less than a predetermined maximum sheet length to pass through the fuser nip created by the closed position of said fuser rollers;

detecting means coupled to said counting means and said electrical control means for detecting the time of entry of sheets entering said fuser nip and for enabling said counting means when sheets whose lengths are less than a predetermined maximum sheet length enter said nip;

whereby said electrical control means operates said latch upon entry of sheets into said fuser nip and does not operate said latch upon countdown of the time required for sheets whose lengths are less than a predetermined maximum sheet length to pass through said fuser nip, thus opening said rollers independent of the contour of said cam.

5. An apparatus according to claim 1 additionally comprising:

counting means coupled to said electrical control means for counting the times required for sheets whose length are less than a predetermined maximum sheet length to pass through the fuser nip created by the closed position of said fuser rollers;

detecting means coupled to said counting means and said electrical control means for detecting the length and time of entry of sheets entering said fuser nip, storing the times required for sheets whose lengths are less than a predetermined maximum sheet length to pass through said fuser nip, selecting the times corresponding to sheets entering said fuser nip whose lengths are less than a predetermined maximum sheet length, loading said counting means with the selected times required for sheets whose lengths are less than a predetermined maximum sheet length to pass through said fuser nip, and enabling said counting means when sheets whose lengths are less than a predetermined maximum sheet length enter said fuser nip;

whereby said electrical control means operates said latch upon entry of sheets into said fuser nip and does not operate said latch upon countdown of the time required for sheets whose lengths are less than a predetermined maximum sheet length to pass through said fuser nip, thus opening said fuser rollers independent of the contour of said cam.

6. An apparatus according to claim 1 additionally comprising:

input means coupled to said electrical control means for receiving a preselected sheet length input;

counting means coupled to said electrical control means and said input means for counting the times required for sheets whose lengths are less than a predetermined maximum sheet length to pass through the fuser nip created by the closed position of said fuser rollers;

detecting means coupled to said counting means and said electrical control means for detecting time of entry of sheets entering said fuser nip, storing the times required for sheets whose lengths are less than a predetermined maximum sheet length to pass through said fuser nip, selecting the times corresponding to sheets entering said fuser nip whose lengths are less than a predetermined maximum sheet length, loading said counting means with the selected times required for sheets whose lengths are less than a predetermined maximum sheet length to pass through said fuser nip, and enabling said counting means when sheets whose lengths are less than a predetermined maximum sheet length enter said fuser nip;

whereby said electrical control means operates said latch upon entry of sheets into said fuser nip and does not operate said latch upon countdown of the time required for sheets whose lengths are less than a predetermined maximum sheet length to pass through said fuser nip, thus opening said fuser rollers independent of the contour of said cam.

7. A xerographic toner fixing apparatus comprising:

substantially parallel first and second cylindrical fuser rollers;

biasing means for maintaining the peripheral surfaces of said fuser rollers in an open position;

a rotatable cam;

means for rotating said cam;

means for recording an image on a photoconductive surface, transferring said image onto a copy medium and then fusing said image onto said copy medium, said cam having a contour for maintaining said fuser rollers in a closed position for images of a predetermined maximum image length;

a linkage mechanism coupling said cam to at least one of said fuser rollers, said linkage mechanism including:

an electromechanically operated latch;

an electrical control means for selectively energizing said electromechanically operated latch; and a means for shifting the peripheral surfaces of said fuser rollers between open and closed positions when said electromechanically operated latch is energized and for retaining said fuser rollers in an open position when said electromechanically operated latch is deenergized.

8. An apparatus according to claim 7 including:

detecting means coupled to said electrical control means for detecting when images are about to be fused and when images have been fused onto a copy medium wherein said electrical control means operates said latch when images are about to be fused and does not operate said latch upon the completion of fusing images onto a copy medium.

9. An apparatus according to claim 7 additionally comprising:

counting means coupled to said electrical control means for storing and counting the times required for using images whose lengths are less than a predetermined maximum length onto a copy medium as said copy medium passes through the fuser nip created by the closed position of said fuser rollers;

detecting means coupled to said counting means and said electrical control means for detecting the length and time of entry of images entering said fuser nip and for selecting the time stored in said counting means corresponding to the lengths of images entering said nip and also for enabling said counting means when said images whose lengths are less than a predetermined maximum image length enter said nip;

whereby said electrical control means operates said latch upon entry of images into said fuser nip and does not operate said latch upon countdown of the time required for images whose lengths are less than a predetermined maximum image length to pass through said fuser nip, thus opening said fuser rollers independent of the countour of said cam.

10. An apparatus according to claim 7 additionally comprising:

input means coupled to said electrical control means for receiving a preselected image length input;

counting means coupled to said electrical control means and said input means for storing and counting the times required for images whose lengths are less than a predetermined maximum image length to be fused on a copy medium in the fuser nip created by the closed position of said fuser rollers;

detecting means coupled to said counting means and said control means for detecting the time of entry of images entering said fuser nip and for enabling said counting means when said images whose lengths are less than a predetermined maximum image length enter said nip;

whereby said electrical control means operates said latch upon entry of images into said fuser nip and does not operate said latch upon countdown of the time required for images whose lengths are less than a predetermined maximum image length to pass through said fuser nip, thus opening said rollers independent of the contour of said cam.

11. An apparatus according to claim 7 additionally comprising:

counting means coupled to said electrical control means for counting the times required for images whose lengths are less than a predetermined maximum image length to pass through the fuser nip created by the closed position of said fuser rollers;

detecting means coupled to said counting means and said electrical control means for detecting the length and time of entry of images entering said fuser nip, storing the times required for images whose lengths are less than a predetermined maximum image length to pass through said fuser nip, selecting the times corresponding to images entering said fuser nip whose lengths are less than a predetermined maximum image length, loading said counting means with the selected times required for sheets whose lengths are less than a predetermined maximum image length to pass through said fuser nip, and enabling said counting means when images whose lengths are less than a predetermined maximum image length enter said fuser nip;

whereby said electrical control means operates said latch upon entry of images into said fuser nip and does not operate said latch upon countdown of the time required for images whose lengths are less than a predetermined maximum image length to pass through said fuser nip, thus opening said fuser rollers independent of the contour of said cam.

12. An apparatus according to claim 1 or 7 additionally comprising:

maintenance means coupled to said electrical control means for detecting the presence of a condition in said xerographic toner fixing apparatus which requires maintenance wherein said electrical control means does not operate said latch upon the presence of said condition, thus opening said fuser rollers independent of the contour of said cam.

13. A xerographic copying apparatus comprising:

a pair of fuser rollers;

a roatable cam;

means for rotating said cam;

means for serially feeding sheets between the peripheral surfaces of said fuser rollers in synchronization with the rotation of said cam, said cam having a contour for maintaining said fuser rollers in a closed position for sheets of a predetermined sheet length;

a linkage mechanism including first and second arms with said first arm being mounted for following the contour of said cam and said second arm being connected to one of said fuser rollers for shifting the peripheral surfaces of said rollers between open and closed positions;

selectively engageable latch means for selectively coupling said second arm to said first arm when said selectively engageable latch is energized so that said arms are fixedly connected whereby the movement of said second arm follows the movement of said first arm to cause said rollers to open and close in response to the contour of said cam; and biasing means for maintaining the peripheral surfaces of said rollers in the open position when said selectively engageable latch is disengaged.

14. A xerographic copying apparatus comprising:

a pair of fuser rollers;

a rotatable cam;

means for rotating said cam;

means for recording an image on a photoconductive surface, transferring said image onto a copy medium and then fusing said image onto said copy medium, wherein said cam has a contour for maintaining said fuser rollers in a closed position for images of a predetermined maximum image length;

a linkage mechanism including first and second arms with said first arm being mounted for following the contour of said cam and said second arm being connected to one of said fuser rollers for shifting the peripheral surfaces of said rollers between open and closed positions; selectively engageable latch means for selectively coupling said second arm to said first arm when said selectively engageable latch is energized so that said arms are fixedly connected whereby the movement of said second arm follows the movement of said first arm to cause said rollers to open and close in response to the contour of said cam; and biasing means for maintaining the peripheral surfaces of said rollers in the open position when said selectively engageable latch is disengaged.

* * * * *